US009291054B2

(12) United States Patent
Kim

(10) Patent No.: US 9,291,054 B2
(45) Date of Patent: Mar. 22, 2016

(54) TUNNEL EXCAVATION DEVICE

(75) Inventor: Dong Hyeon Kim, Seoul (KR)

(73) Assignee: KOREA RAILROAD RESEARCH INSTITUTE, Gyeonggi-do (KR)

( * ) Notice: Subject to any disclaimer, the term of this patent is extended or adjusted under 35 U.S.C. 154(b) by 15 days.

(21) Appl. No.: 14/358,470

(22) PCT Filed: May 31, 2012

(86) PCT No.: PCT/KR2012/004303

§ 371 (c)(1),
(2), (4) Date: May 15, 2014

(87) PCT Pub. No.: WO2013/073754

PCT Pub. Date: May 23, 2013

(65) Prior Publication Data

US 2014/0327292 A1 Nov. 6, 2014

(30) Foreign Application Priority Data

Nov. 17, 2011 (KR) ..... 10-2011-0120467

(51) Int. Cl.

| | |
|---|---|
| ***E21D 9/10*** | (2006.01) |
| ***E21D 9/08*** | (2006.01) |
| ***E21D 9/11*** | (2006.01) |

(52) U.S. Cl.

CPC ..... *E21D 9/1066* (2013.01); *E21D 9/085* (2013.01); *E21D 9/1073* (2013.01); *E21D 9/112* (2013.01)

(58) Field of Classification Search

CPC ..... E21D 9/1073; E21D 9/1066
See application file for complete search history.

(56) References Cited

U.S. PATENT DOCUMENTS 3,152,651 A * 10/1964 Ross ..... 175/11

FOREIGN PATENT DOCUMENTS

| | | | |
|---|---|---|---|
| DE | 22348070 | * | 1/1974 |
| JP | 05-141169 | | 6/1993 |
| JP | 05141169 | * | 6/1993 |
| JP | 11-294062 | | 10/1999 |
| KR | 10-2003-0029722 | | 5/2003 |
| KR | 10-0614795 | | 8/2006 |
| RU | 2026989 | * | 1/1995 |

OTHER PUBLICATIONS

International Search Report mailed Dec. 6, 2012 for PCT/KR2012/004303.

* cited by examiner

*Primary Examiner* — John Kreck

(57) ABSTRACT

The invention relates to a tunnel excavation device, which includes an excavation head, a main body on which the excavation head is rotatably mounted, a motor provided in the main body and rotates the excavation head, and a controller for controlling the motor, wherein the excavation head includes a perforating means formed by maintaining a predetermined interval from the center of a body part, which has a front surface formed in the shape of a circular plate, to the outer surface of the body part, an injection means for injecting water and liquid nitrogen into the hole formed by the perforating means, and a plurality of cutters provided on the surface of the main body for crushing the bedrock.

7 Claims, 3 Drawing Sheets

TUNNEL EXCAVATION DEVICE

This application claims the priority of Korean Patent Application No. 10-2011-0120467, filed on Nov. 17, 2011 in the KIPO (Korean Intellectual Property Office), the disclosure of which is incorporated herein entirely by reference. Further, this application is the National Stage application of International Application No. PCT/KR2012/004303, filed May 31, 2012, which designates the United States and was published in Korean. Each of these applications is hereby incorporated by reference in their entirety into the present application.

TECHNICAL FIELD

The present invention relates to a tunnel excavation device, and more particularly, to a tunnel excavation device which forms holes on a bedrock through a perforating means provided on an excavation head thereof for excavating a tunnel, and injects water and liquefied nitrogen into the holes to allow the bedrock to be easily crushed using a property of water which expands upon freezing.

BACKGROUND ART

In general, various methods are being used in constructing a tunnel used for roads or railways. Hard bedrock is generally destructed using explosives and is excavated using excavation equipment.

With the recent development of large-scale equipment called a tunnel boring machine (TBM), tunnels have been constructed without using explosives. In the TBM based tunnel construction, an excavation work is carried out on a circular cross-section, which is a mechanically stable, vibration-free, non-blasting method. Thus, the TBM based tunnel construction may be an environmentally friendly tunnel excavation method, that is, ground deformation due to a ground excavation is minimized, thereby securing maximized stability during construction by ground excavation. In addition, environmental damages due to noise and vibration can be minimized, thereby maintaining tunnel working conditions in a safe and clean state.

The above tunnel excavation device is capable of excavating the entire cross-section of a tunnel by rotating a disk-shaped excavation head with a bit, a cutter, etc. attached thereto, or freely excavating a required cross-section of a tunnel by freely moving a drum with a bit, a cutter, etc. attached thereto. The above tunnel excavation device is particularly effectively used when a tunnel is constructed in a relatively hard ground, like in a mountainous area.

Meanwhile, the conventional tunnel excavation device is proposed in Korean Utility Model Registration No. 0368000, which relates to a non-vibration tunnel excavator. The proposed tunnel excavator comprises: a central shaft having a central core drill provided at a front end thereof for perforating a central groove in a rock surface when rotated by a driving means, and having a piston rotatably coupled to a lengthwise middle part thereof through a slide sheet for moving the central shaft forward and backward; a cylinder member to which the central shaft is rotatably coupled, the cylinder member having a slide space in which a piston is slidably inserted and can be moved forward and backward with a predetermined range according to a hydraulic pressure to move the central shaft forward and backward; an outer core groove perforating member being rotated together with the central shaft, the outer core groove perforating member having a rotating plate fitted integrally into a front drill assembling part of the central shaft through a central part thereof, a core pipe coupled to the edge of the rotating plate and protruded forward as long as a length of the central core drill, a cutting bite combined with the front edge of the core pipe for forming a core groove, and at least one operator-guiding hole formed on a circumference of the rotating plate for allowing an operate to pass therethrough; a support member combined with an outer part of the cylinder member and selectively fixed to an inner wall of a hole via a plurality of jacks which are positioned on the inner wall of a hole formed by the outer core groove perforating member to then be provided to the exterior part; at least one crushing core drill member detachably coupled with the rotating plate of the outer core groove perforating member, and having a core drill provided at a front end thereof and rotated by the driving means; and a control unit controlling components of the above members when power is applied.

However, the tunnel excavation device disclosed in the above registered utility model has poor excavation efficiency because a plurality of grooves are formed on a surface of the bedrock by means of the central core drill and a plurality of core drills for tunnel excavation and then crushed immediately. In addition, the device disclosed in the above utility model does not effectively prevent a shortening of life span caused by abrasion of outer core groove perforating member and various types of cutters.

DISCLOSURE OF THE INVENTION

Technical Problem

The present invention has been made in an effort to solve the problems of the prior art, and it is an object of the present invention to provide which forms holes on a bedrock through a perforating means provided on an excavation head thereof for excavating a tunnel, and injects water and liquefied nitrogen into the holes to allow a crack and a breakage of the bedrock to be induced using a property of water which expands upon freezing and then the bedrock to be easily crushed.

Technical Solution

In accordance with an aspect of the present invention, the above and other objects can be accomplished by providing a tunnel excavation device tunnel excavation device including an excavation head, a main body on which the excavation head is rotatably mounted, a motor provided in the main body and rotates the excavation head, and a controller for controlling the motor. Here, the excavation head includes a perforating means provided on a body part having a front surface formed in the shape of a circular plate, the perforating means being disposed at regular intervals from a center to an outside of the body part; an injection means for injecting water and liquid nitrogen into the hole formed by the perforating means; and a plurality of cutters provided on the surface of the body part for crushing the bedrock.

At this time, the cutters may be cutting type or press type cutters.

Also, the perforating means may be laser drills or wedge-type drills provided in a body part of the excavation head and disposed at regular intervals from the center to the outer surface of the excavation head.

In addition, the injection means includes a support member provided on the body part of the excavation head, a water injection nozzle provided in the support member for forwardly injecting water, and a liquefied nitrogen injection nozzle provided in the support member for injecting liquefied nitrogen.

Furthermore, water injected through the water injection nozzle is supplied from a water storage tank by an operation of a water transfer pump according to a control unit, and liquefied nitrogen injected through the liquefied nitrogen injection nozzle is supplied from a liquefied nitrogen storage tank by an operation of liquefied nitrogen transfer pump according to the control of the control unit.

Also, the support member may include a contact part which is provided at a front end of the support member and can be in contact with the bedrock provided at its front end.

In particular, the support member may further include first and second cylinders for moving the water injection nozzle and the liquefied nitrogen injection nozzle forward and backward to allow the liquefied nitrogen injection nozzle to be moved backward while water is injected from the water injection nozzle and to allow the water injection nozzle to be moved backward while liquefied nitrogen is injected from liquefied nitrogen injection nozzle.

And, the water injection nozzle may have a first valve provided at one side thereof and the liquefied nitrogen injection nozzle may have a second valve provided at one side thereof.

Also, it is preferably that the perforating means are concentrically disposed from the center of the body part.

In addition, the contact part may have a heating member which is controlled by the control unit and formed integrally therewith.

Advantageous Effects

According to the present invention, when an excavation work is performed, the bedrock is crushed by forming holes using perforating means such as laser drills, and injecting water and liquefied nitrogen into the holes, thereby reducing vibrations, noises and dust in the vicinity of the excavation site and increasing the processing speed.

In particular, the tunnel excavation device according to the present invention has a longer excavation distance than the conventional TBM per a day, thereby shortening the overall tunnel construction period. In addition, since the life span affected by abrasion of cutters is lengthened, the replacement period of the cutters is extended, thereby saving maintenance costs.

MODE FOR CARRYING OUT THE INVENTION

Advantages and features of a tunnel excavation device according to the present invention will be understood through exemplary embodiments thereof with reference to the accompanying drawings.

Figure 1:
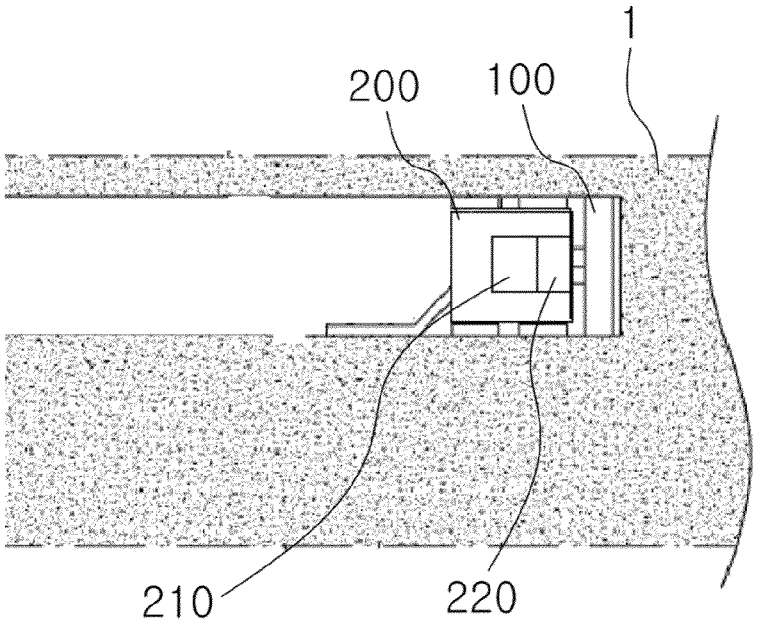
FIG. 1 illustrates an example of excavation state using a tunnel excavation device according to the present invention.
Figure 2:
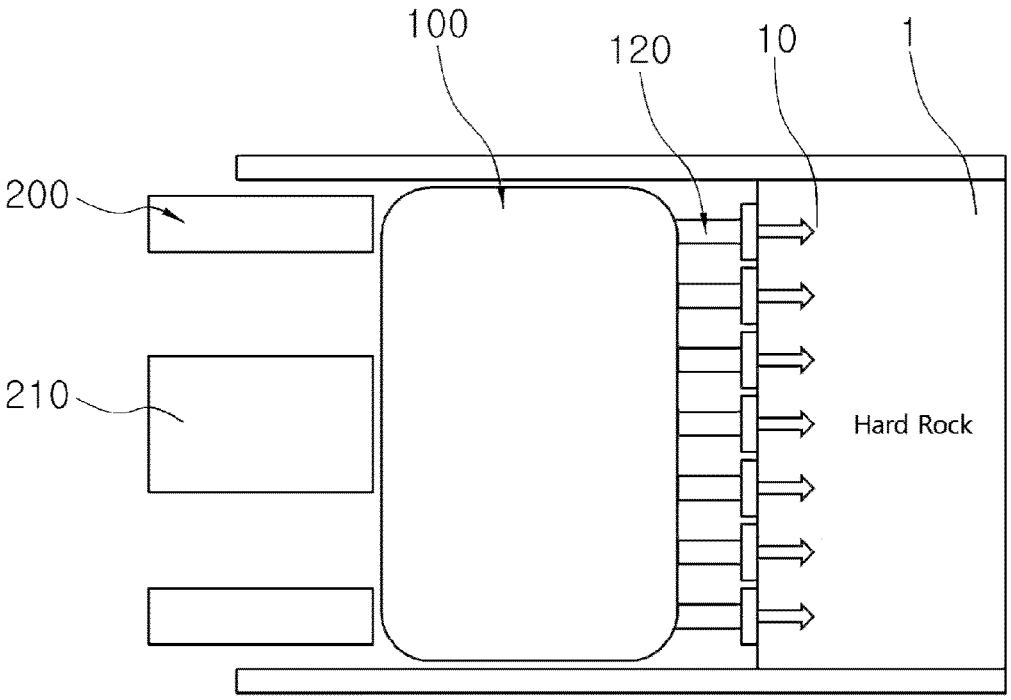
FIG. 2 is a cross-sectional view of an excavation head of the tunnel excavation device according to the present invention.
Figure 3:
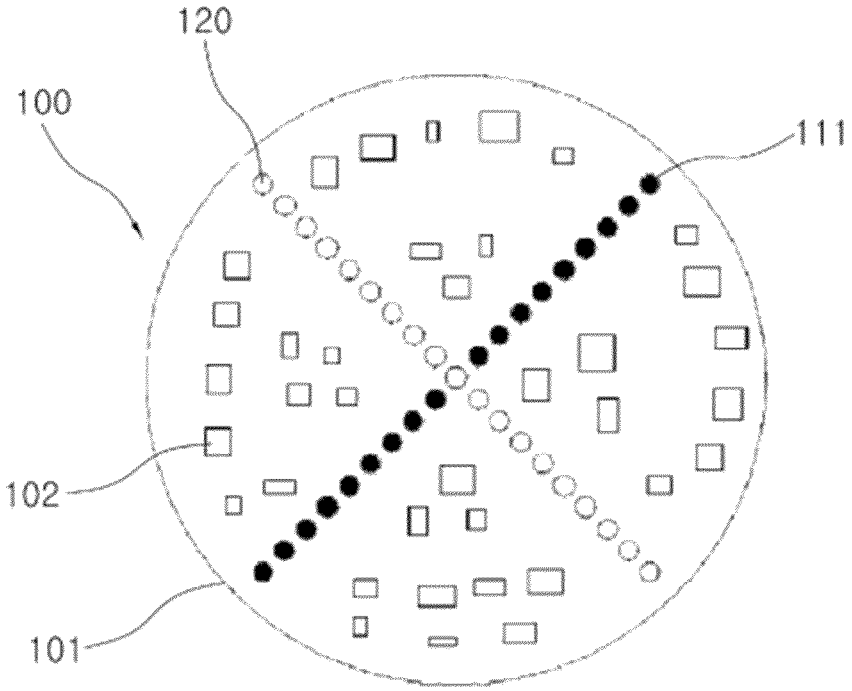
FIG. 3 is a front view of the excavation head of the tunnel excavation device according to the present invention.
Figure 4:
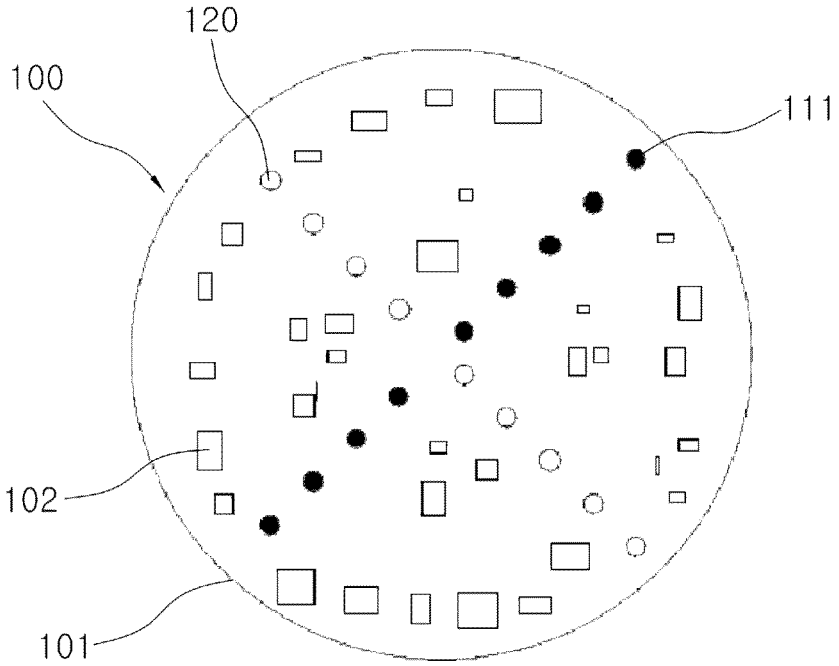
FIG. 4 is a front view of another example of the excavation head of the tunnel excavation device according to the present invention.
Figure 5:
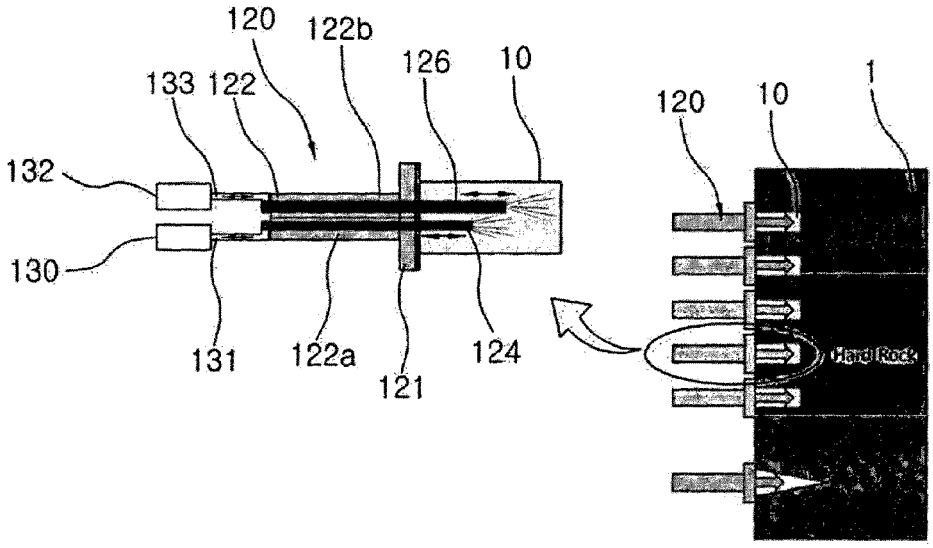
FIG. 5 is a view illustrating an injection means constituting to the present invention.
Figure 6:
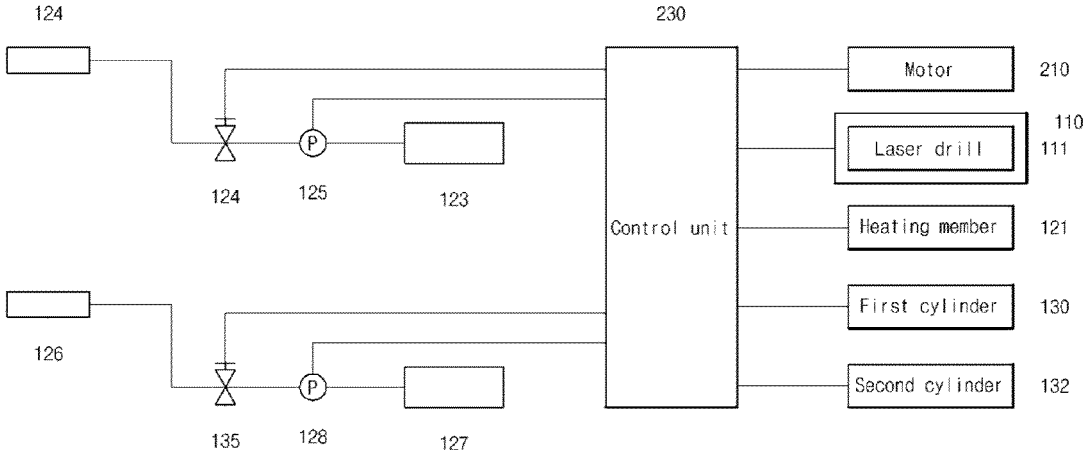
FIG. 6 is a control diagram of the tunnel excavation device according to the present invention.

FIG. 1 illustrates an example of excavation state using a tunnel excavation device according to the present invention, FIG. 2 is a cross-sectional view of an excavation head of the tunnel excavation device according to the present invention, FIG. 3 is a front view of the excavation head of the tunnel excavation device according to the present invention, FIG. 4 is a front view of another example of the excavation head of the tunnel excavation device according to the present invention, FIG. 5 is a view illustrating an injection means constituting to the present invention and FIG. 6 is a control diagram of the tunnel excavation device according to the present invention.

Referring to FIGS. 1 to 6, the tunnel excavation device according to the present invention includes an excavation head 100, a main body 200 in which the excavation head 100 is rotatably installed, a motor 210 and a decelerator 220 which are provided within the main body 200 and rotate the excavation head 100, and a control unit 230 controlling the motor 210.

The main body 200 is formed in the shape of a cylinder and is preferably separated into a front body to which the excavation head 100 is rotatably mounted through a front surface thereof and a tail body in which the motor 210 and the decelerator 220 are installed.

The present invention using a new conceptual tunnel boring machine (TBM) forms several to several hundreds of small holes 10 on a surface of a hard rock using a laser, injects water and liquefied nitrogen into the holes 10 and instantaneously freezes water to crack or break the hard rock using a cooling expansion force generated during solidification of water, and crushes the bedrock 1 using cutting type or press type cutters 102 performing an intrinsic function of TBM.

Here, liquefied nitrogen is obtained by liquefying nitrogen and exists in a liquid phase at −196° C. under atmospheric pressure. The critical temperature of nitrogen is −147.21° C. and the critical pressure of nitrogen is 33.5 atm. Nitrogen has a two-element molecule and is a gas element occupying approximately 80% of the air by volume. The nitrogen can be industrially obtained through fractionating liquefaction of air and can be chemically obtained by heating mixed solution of ammonium chloride and sodium nitrite at 70° C., followed by fractionating by distillation.

Since the main body 200 has been well known in the art, a detailed description thereon will be omitted. In the following description, a configuration of the excavation head 100, which is an essential part of the present invention, will be described in detail.

The excavation head 100 of the present invention includes perforating means 110 formed on the body part 101 for forming holes 10 on a surface of the bedrock 1 and spaced from each other at regular intervals from the center to an outside of the body part 101 having a front circular plate, injection means 120 concentrically provided with the perforating means 110 at the center of the body part 101 for injecting water and liquid nitrogen into the holes 10 formed by the perforating means 110, and a plurality of cutters 102 provided on the surface of the body part 101 for crushing the bedrock 1. The perforating means 110 and the injection means 120 may be arranged in various manners, as shown in FIGS. 3 and 4.

In other words, the holes 10 are formed on the bedrock 1 by means of the perforating means 110 provided on the excavation head 100, water and liquefied nitrogen are injected into the holes 10 through the injection means 120, and water is frozen and is expanded to induce cracks and breakage in the vicinity of the holes 10 formed on the bedrock 1, thereby easily crushing the bedrock 1 using the cutters 102.

At this time, cutting type or press type cutters may be utilized as the cutters 102 to crush and excavate the bedrock 1.

Firstly, the perforating means 110 are provided on a front surface of the excavation head 100 and spaced from each other at regular intervals from a center to an outside of the body part, the perforating means may consist of laser drills 111.

Once the excavation head 100 is rotated, the plurality of laser drills 111 are moved along concentric circles and form the plurality of holes 10. At this time, the laser drills 111 projects laser pulses onto the surface of the bedrock 1 to form a plurality of holes 10 on the surface of the bedrock 1.

Instead of the laser drills 111, meanwhile, wedge-type drills (not shown) which have well known in the art may be employed as the perforating means 110 to form the holes 10.

Meanwhile, water and liquefied nitrogen injected from the injection means 120 provided in the body part 101 of the excavation head 100 are injected into the holes 10 formed by the laser drills 111 acting as the perforating means 110, and water is then frozen and expanded in the holes so that a creation of cracks and breakage in the vicinity of the holes 10 formed in the bedrock 1 is induced.

The injection means 120 as described above includes a support member 122 provided on the body part 101 of the excavation head 100, a water injection nozzle 124 provided in the support member 122 for forwardly injecting water, and a liquefied nitrogen injection nozzle 126 provided in the support member 122 for injecting liquefied nitrogen.

At this time, water injected through the water injection nozzle 124 is supplied from a water storage tank 123, and a water transfer pump 125 is operated according to a control of the control unit 230 to inject water through the water injection nozzle 124.

Liquefied nitrogen injected through the liquefied nitrogen injection nozzle 126 is supplied from a liquefied nitrogen storage tank 127, and a liquefied nitrogen transfer pump 128 is operated according to a control of the control unit 230 to inject liquefied nitrogen through the liquefied nitrogen injection nozzle 126.

Meanwhile, the support member 122 is formed integrally with the body part 101 of the excavation head 100 and includes a contact part 120*a* which is provided at a front end thereof and can be in contact with the bedrock 1. The contact part is formed in the shape of a rectangle to have a "–"-shaped configuration as a whole, and a heating member 121 is formed integrally with the contact part 120*a*.

Due to the above configuration, when water injected from the water injection nozzle 124 is cooled by liquefied nitrogen injected from the liquefied nitrogen injection nozzle 126, cracks and breakage are created in the vicinity of the holes 10 formed in the bedrock 1 while water is frozen and expanded.

At this time, water is cooled and frozen, the contact part 120*a* is adhered to the surface of the bedrock 1 by the ice. To avoid this phenomenon, the contact part 120*a* is heated by applying electricity to a heat wire plate acting as the heating member 121 to melt the ice between the contact part 120*a* and the bedrock 1.

Meanwhile, the support member 122 further includes first and second cylinders 130 and 132 for moving the water injection nozzle 124 and the liquefied nitrogen injection nozzle 126 forward and backward to allow the liquefied nitrogen injection nozzle 126 to be moved backward while water is injected from the water injection nozzle 124 and to allow the water injection nozzle 124 to be moved backward while liquefied nitrogen is injected from the liquefied nitrogen injection nozzle 126.

In other words, first and second guide holes 122*a* and 122*b* are formed in the support member 122 to allow the water injection nozzle 124 and the liquefied nitrogen injection nozzle 126 to be moved forward and backward. In detail, one side of the water injection nozzle 124 is fixed to a piston 131 of the first cylinder 130 to allow the water injection nozzle 124 to be moved forward and backward along the first guide hole 122*a* formed in the support member 122, and one side of the liquefied nitrogen injection nozzle 126 is fixed to a piston 133 of the second cylinder 132 to allow the liquefied nitrogen injection nozzle 126 to be moved forward and backward along the second guide hole 122*b* formed in the support member 122.

Due to the above configuration, while the water injection nozzle 124 and the liquefied nitrogen injection nozzle 126 are alternately moved forward and backward, water and liquefied nitrogen are alternatively injected into the holes 10 formed in the bedrock 1 so that water is cooled and a volume of water expands.

At this time, in order to alternately inject water and liquefied nitrogen, a first valve 134 is provided at one side of the water injection nozzle 124, and a second valve 135 is provided at one side of the liquefied nitrogen injection nozzle 126.

Solenoid valves are utilized as the first and second valves 134 and 135 and opened/shut according to a control signal of the control unit 230. As a result, these valves are opened to inject water or liquefied nitrogen only when the liquefied nitrogen injection nozzle 126 or the water injection nozzle 124 is moved forward.

Meanwhile, in a case where the holes 10 are formed on the surface of the bedrock 1 by means of the perforating means 110 and the injection means 120 and water and liquefied nitrogen are injected into the holes 10 to cool water, forward and backward moving cylinders (not shown) are provided at rear ends of the perforating means 110 and the injection means 120 to allow the perforating means 110 and the injection means 120 to be moved backward to the inside of the excavation head 100, and the perforating means 110 and the injection means 120 may also be integrally fixed to the forward and backward moving cylinders.

In a state in which the perforating means 110 and the injection means 120 are moved backward with the aforementioned configuration, if the excavation head 100 is rotated, the cutters 102 are in closely contact with the surface of the bedrock 1 and crush the bedrock 1 on which cracks are created by frozen water.

Hereinafter, one example of an operation of the tunnel excavation device according to the present invention is described with reference to FIGS. 1 to 3.

First of all, if the motor 210 and the decelerator 220 are driven by operating the control unit 230, the excavation head 100 provided at a front side of the main body 200 is rotated.

At this time, while the excavation head 100 is rotated, the perforating means 110 is operated to form the holes 10 on the surface of the bedrock 1.

In other words, while the excavation head 100 is rotated, the holes 10, each of which having a small diameter, are formed in the bedrock 1, particularly, hard rock, at regular intervals by means of the high-temperatured laser drills 111 acting as the perforating means 110.

Meanwhile, the holes 10 perforated by the perforating means 110 are formed at regular intervals from the center to the outer side of the excavation head 100, and while the excavation head 100 is rotated, the injection means 120 is moved to the holes 10 and sequentially injects water and liquefied nitrogen into the holes 10.

That is to say, the liquefied nitrogen injection nozzle 126 and the water injection nozzle 124 are alternately moved forward into the holes 10 and inject alternatively liquefied nitrogen and water to fill the holes 10 from their inner parts to entrance parts with liquefied nitrogen and water.

In addition, the contact part 120*a* is pressed against the entrance part of the hole 10 and liquefied nitrogen is finally injected from the liquefied nitrogen injection nozzle 126 with an intense pressure.

Meanwhile, when the liquefied nitrogen injection nozzle 126 is moved forward and injects liquefied nitrogen, the water injection nozzle 124 gets into the injection means 120 so as not to be exposed to liquefied nitrogen. After an expanding force is applied to the bedrock 1 by cooling and expanding water, a temperature of the heat wire plate acting as the heating member 121 is raised to separate the injection means 120 from the bedrock 1.

Therefore, cracks and breakage are created in to the vicinity of the holes 10 formed on the surface of the bedrock 1, thereby allowing the cutters 102 to easily crush the bedrock 1.

According to the present invention as described above, since an excavation work is performed by forming the holes 10 by means of the perforating means 110 such as laser drills 111, injecting water and liquefied nitrogen into the holes 10 and crushing the bedrock 1, vibrations, noises and dust in the vicinity of the excavation site are reduced and the processing speed is increased.

In particular, the tunnel excavation device according to the present invention can excavate longer distance per a day excavation distance than the conventional TBM, thereby shortening the overall tunnel construction period. In addition, since the life span affected by abrasion of cutters is lengthened, the replacement period of the cutters is extended, thereby saving maintenance costs.

Although the preferred embodiments have been described to practice the tunnel excavation device according to the present invention, these embodiments are set forth for illustrative purposes and do not serve to limit the invention. Those skilled in the art will readily appreciate that many modifications and variations can be made, without departing from the spirit and scope of the invention as defined in the appended claims, and such modifications and variations are encompassed within the scope and spirit of the present invention.

Explanation of reference numerals

| | |
|---|---|
| 1: Bedrock | 10: Holes |
| 100: Excavation head | 102: Cutters |
| 110: Perforating means | 111: Laser drills |
| 120: Injection means | 122: Support member |
| 124: Water injection nozzle | 126: Liquefied nitrogen injection nozzle |
| 200: Main body | 210: Motor |
| 230: Control unit | |

The invention claimed is:

1. A tunnel excavation device including an excavation head, a main body to which the excavation head is rotatably mounted, a motor provided in the main body for rotating the excavation head, and a controller for controlling the motor, the excavation head comprising:

a perforating part provided on a body part having a front surface formed in the shape of a circular plate, the perforating part being disposed at regular intervals from a center to an outside of the body part for forming a hole on a bedrock;

an injection part for injecting water and liquid nitrogen into the hole formed by the perforating part; and a plurality of cutters provided on the surface of the body part for crushing the bedrock;

wherein the injection part includes a support member provided on the body part of the excavation head, a water injection nozzle provided in the support member for forwardly injecting water, and a liquefied nitrogen injection nozzle provided in the support member for injecting liquefied nitrogen; and the support member includes a contact part which is provided at a front end of the support member and can be in contact with the bedrock provided at its front end, the contact part has a heating member controlled by the control unit and formed integrally therewith.

2. The tunnel excavation device of claim 1, wherein the perforating part is drills provided in a body part of the excavation head and disposed at regular intervals from the center to the outer surface of the excavation head.

3. The tunnel excavation device of claim 1, wherein water injected through the water injection nozzle is supplied from a water storage tank by an operation of a water transfer pump according to a control unit, and liquefied nitrogen injected through the liquefied nitrogen injection nozzle is supplied from a liquefied nitrogen storage tank by an operation of liquefied nitrogen transfer pump according to the control of the control unit.

4. The tunnel excavation device of claim 1, wherein the support member further includes first and second cylinders for moving the water injection nozzle and the liquefied nitrogen injection nozzle forward and backward to allow the liquefied nitrogen injection nozzle to be moved backward while water is injected from the water injection nozzle and to allow the water injection nozzle to be moved backward while liquefied nitrogen is injected from liquefied nitrogen injection nozzle.

5. The tunnel excavation device of claim 1, wherein the water injection nozzle has a first valve provided at one side thereof and the liquefied nitrogen injection nozzle has a second valve provided at one side thereof.

6. The tunnel excavation device of claim 2, wherein the drills of the perforating part are concentrically disposed from the center of the body part.

7. The tunnel excavation device of claim 1, wherein the nozzles of the injection part are concentrically disposed from the center of the body part.

* * * * *